US005718524A

United States Patent [19]

Nordström et al.

[11] Patent Number: 5,718,524

[45] Date of Patent: Feb. 17, 1998

[54] DEVICE IN PRINTERS

[75] Inventors: Hans Nordström, Västra Frölunda; Kjell Wollin, Mölndal, both of Sweden

[73] Assignee: UBI Printer AB, Molndal, Sweden

[21] Appl. No.: 534,567

[22] Filed: Sep. 27, 1995

[30] Foreign Application Priority Data

Oct. 3, 1994 [SE] Sweden ..... 9403354

[51] Int. Cl.[6] ..... B41J 35/04

[52] U.S. Cl. ..... 400/248; 400/242

[58] Field of Search ..... 400/207, 208, 400/247, 248, 215, 242, 246, 579; 226/21; 242/130.4, 157 R, 533.4, 563.1

[56] References Cited

U.S. PATENT DOCUMENTS

| | | | |
|---|---|---|---|
| 3,701,318 | 10/1972 | Lozeom et al. | 400/246 |
| 3,900,099 | 8/1975 | Henzelbaupt | 400/215 |
| 4,568,210 | 2/1986 | Psivitera | 400/208 |
| 4,776,714 | 10/1988 | Sugiura et al. | 400/248 |

FOREIGN PATENT DOCUMENTS

| | | | |
|---|---|---|---|
| 0558620 | 9/1932 | Germany . | |
| 2346167 | 3/1975 | Germany | 400/246 |
| 59-218879 | 10/1984 | Japan . | |
| 194883 | 11/1984 | Japan | 400/248 |
| 189974 | 8/1986 | Japan | 400/248 |
| 055183 | 3/1987 | Japan | 400/248 |
| 069681 | 3/1988 | Japan | 400/248 |
| 286381 | 11/1988 | Japan | 400/242 |

*Primary Examiner*—Ren Yan
*Attorney, Agent, or Firm*—Dvorak & Orum

[57] ABSTRACT

The invention concerns a device in printers of the kind wherein an ink ribbon (5) is arranged to be reeled off an unwinding roller (4) and to be wound onto a take-up roller (6) after having passed through a printing unit (7). In order to compensate for any skewing forces occuring in the ribbon (5), the unwinding roller (4) and/or the take-up roller (6) is/are mounted on a rotatable shaft (8) which is provided with a pivot mechanism (9, 11, 12; 21; 22, 24), allowing correcting guide movements of said ribbon (5).

3 Claims, 3 Drawing Sheets

DEVICE IN PRINTERS

BACKGROUND OF THE INVENTION

1. Field of the Invention

The invention concerns a device in printers and more particularly a device in printers of the kind wherein an ink ribbon is arranged to be reeled off an unwinding roller and to be wound onto a take-up roller after having passed through a printing unit for application of print on a web which is being advanced simultaneously with said ribbon through said printing unit.

2. Description of the Prior Art

Printers are used in a large variety of applications to print e.g. receipts or labels. The printer may comprise a web of labels and an ink ribbon, said web and said ribbon being advanced in parallel through a printing unit. With the aid of the ink ribbon the printing unit applies print on the labels, the latter being dispensed from the printer one by one.

However, it has hitherto been difficult to advance the web or the ribbon in such a manner that skewing thereof is prevented, which primarily is caused by a lack of parallelism between the winding-on and the winding-off shafts and also any deflection rollers positioned therebetween. This lack of parallelism may cause the ink ribbon to wrinkle, resulting in imperfect print on the labels.

Attempts have been made to use edge sensing of the ribbon and/or the web to achieve continous guidance so as to cause the ribbon/web to be advanced while correctly orientated. However, the result is far from satisfactory. This is true particularly as concerns the ink ribbon which is very thin and consequently lacks the rigidity required to ensure an acceptable accuracy of the edge-sensing operation.

SUMMARY OF THE INVENTION

The subject invention provides a device by means of which the problems outlined above are solved. The characteristic feature of the device in accordance with the invention is a pivot mechanism mounted on either the unwinding or take-up roller which allows correction of guide movements of the ribbon upon skewing. Owing to the device automatic and successive correction of the forces acting on the ribbon is achieved during the on-going advancement of the ribbon or web.

BRIEF DESCRIPTION OF THE DRAWINGS

The invention will be described in closer detail in the following with reference to the accompanying drawings wherein.

DESCRIPTION OF THE PREFERRED EMBODIMENT

Figure 1:
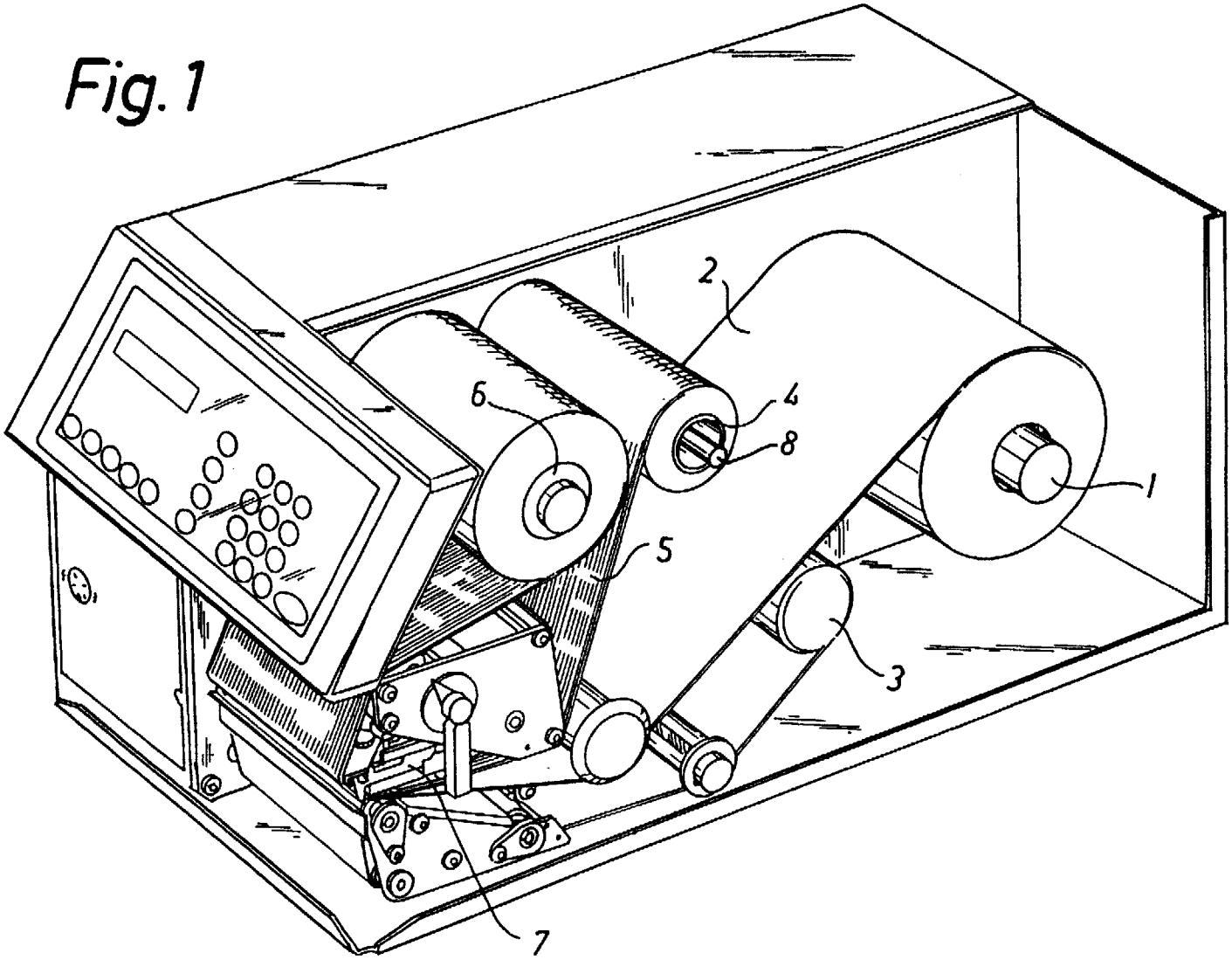
FIG. 1 illustrates a printer in a perspective view with a lateral wall removed.

FIG. 1 illustrates a printer. The latter comprises an unwinding roller 1 designed to unreel a web of labels 2, and a take-up-roller 3, to receive said web, an unwinding roller 4 for unfeeling an ink ribbon 5 and a take-up-roller 6 for reception of the ink ribbon. The web 2 and the ribbon 5 are advanced in parallel through a printing unit 7. After the printing and feed-out of labels, not illustrated in the drawing figures, from the printing unit 7 the web 2 of labels is deflected downwards and the ink ribbon is deflected upwards and the web and the ribbon are wound onto their respective one of the take-up rollers 3, 6.

For the sake of simplicity the following description relates to the application of the invention only with respect to the unwinding roller 4 of the ink ribbon 5. This roller 4 is mounted on a rotatable shaft 8 which is provided with a pivot mechanism in accordance with one embodiment of the invention, see FIG. 2. This mechanism comprises a guide sleeve 9 onto which the unwinding roller 4 of the ink ribbon 5 may be threaded and which sleeve is provided with a spring plate 10 designed to create, in a manner known per se, good frictional contact between the guide sleeve 9 and the unwinding roller 4. The guide sleeve 9 forms a unit jointly with an intermediate sleeve 11 and a ring 12 of a resilient material which is disposed between the two sleeves 9 and 11. The unit 9, 11, 12 may be made from a thermoplastic material and be moulded intergrally in one piece. Alternatively, the sleeves 9 and 11 could be made from metal and the ring 12 from rubber, the ring being secured between the sleeves 9 and 11 by means of vulcanization.

The unit 9, 11, 12 may be threaded onto an inner sleeve 13 which in turn is arranged to be threaded onto the rotatable shaft 8. The latter is provided with a plurality of peripherally extending grooves 14 and one or several locking tongues 15 are provided on the inner sleeve 13 and arranged to engage in one of these grooves 14. In this manner, the pivot mechanism may be shifted into various set positions on the rotatable shaft 8 for adaptation to various dimensions of the unwinding roller 4, i.e. to varying widths of the ink ribbon 5. A sleeve-like locking member 16 is arranged to force the locking tongue or tongues 15 into one of the grooves 14 and it is maintained in this position by means of a spring 17 urging the locking member 16 into engagement with an end shoulder 18 formed on the inner sleeve 13 and at the same time the pivot mechanism 9, 11, 12 into abutment against a transverse flange 19 formed at the opposite end of the inner sleeve 13.

Figure 2:
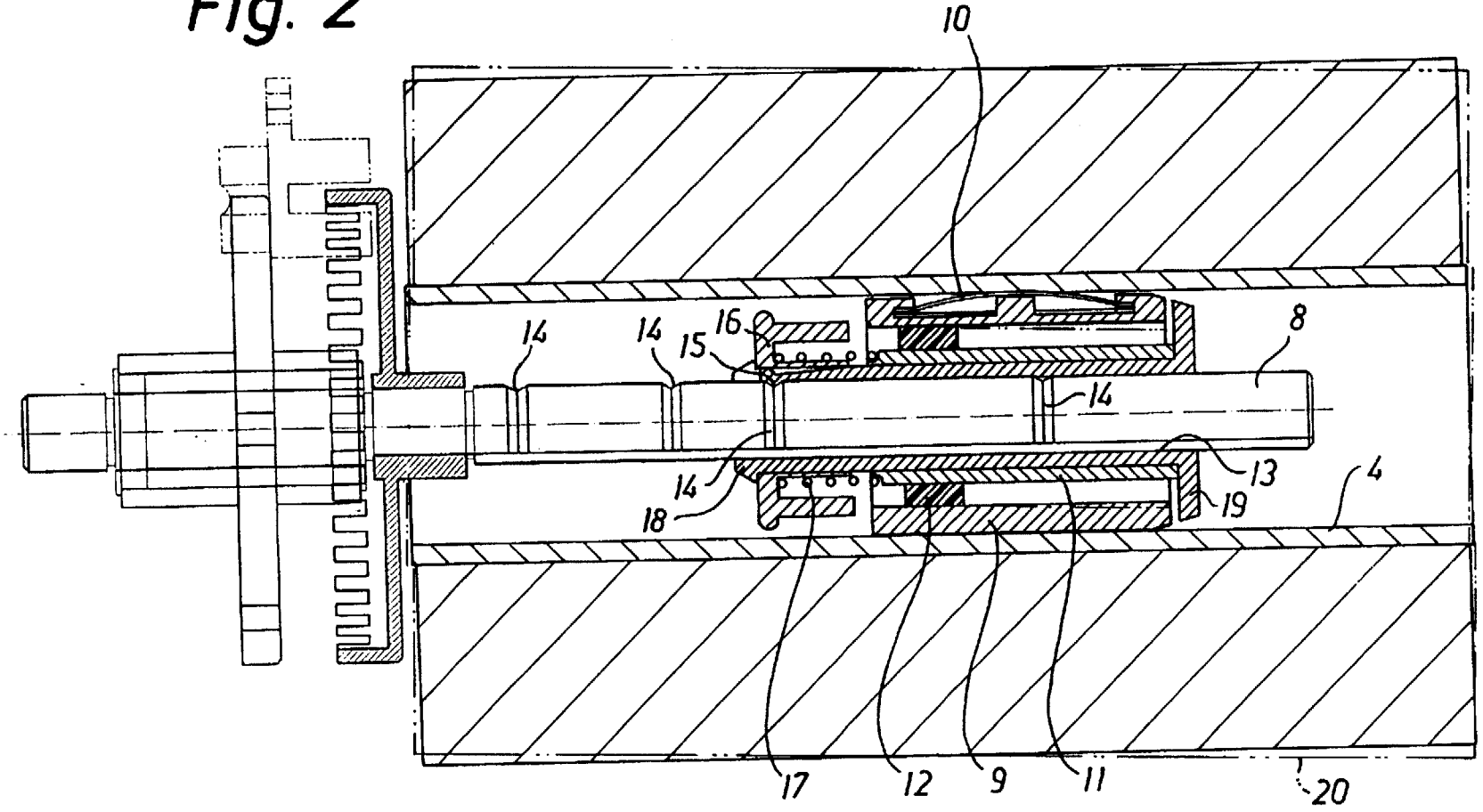
FIG. 2 is a longitudinal sectional view through the device according to a first embodiment of the invention.

The device indicated in FIG. 2 at the far left side is a fork-shaped optical scanner serving to sense the unreeling of the ink ribbon 5 and thus forming no part of the subject application.

As soon as the ink ribbon 5 tends to be pulled somewhat askew off the unwinding roller 4 the pivot mechanism, owing to the presence of the resilient ring 12, will allow the roller 4 to assume a slightly oblique position, for instance as suggested by the dash-and-dot line 20. Owing to this compensatory effect the ink ribbon 5 will follow the correct path through the printing unit 7 and up to the take-up-roller 6, thus without running the risk of being wrinkled. Printing of fully acceptable labels thus is ensured. Should a change of load on the ink ribbon 5 in the opposite direction occur, the pivot mechanism 9, 11, 12 will immediately compensate therefor. Consequently, successive and automatic guidance of the ink ribbon 5 is effected in a simple manner with the aid of the pivot mechanism 9, 11, 12.

Figure 4:
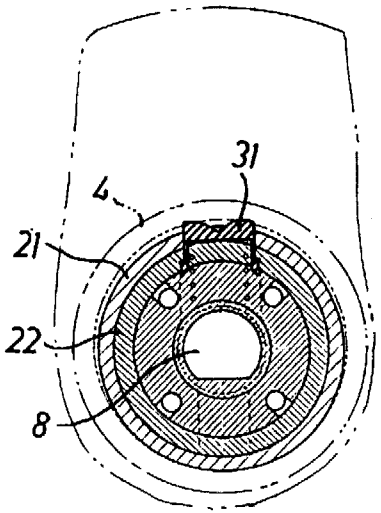
FIG. 4 is a cross-sectional view along line IV—IV of FIG. 3
Figure 3:
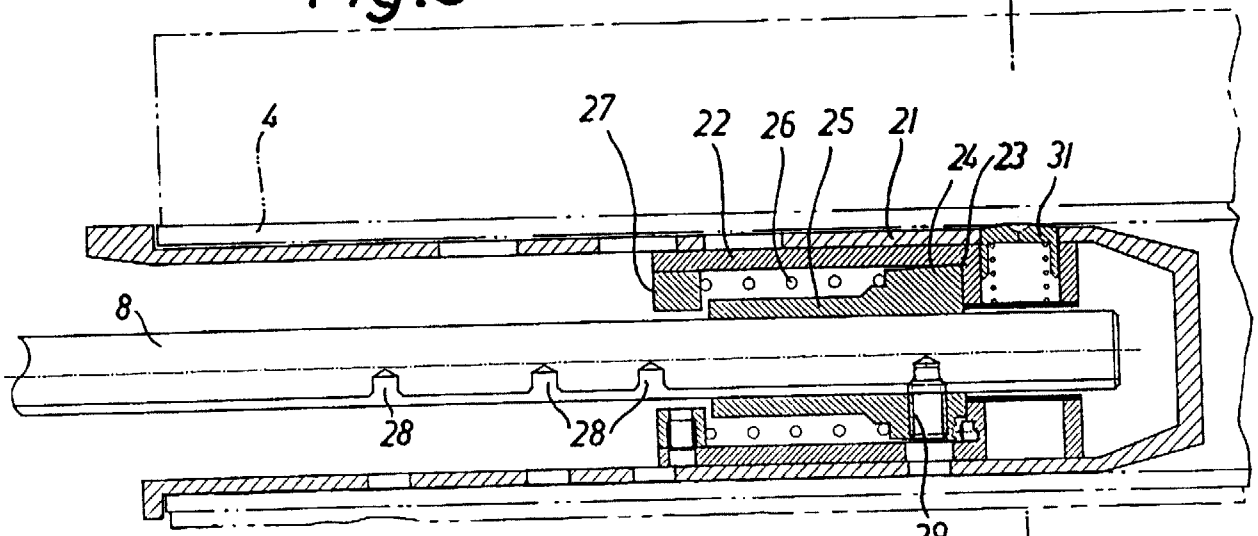
FIG. 3 is a longitudinal sectional view through the device in accordande with the second embodiment of the invention.
Figure 5:
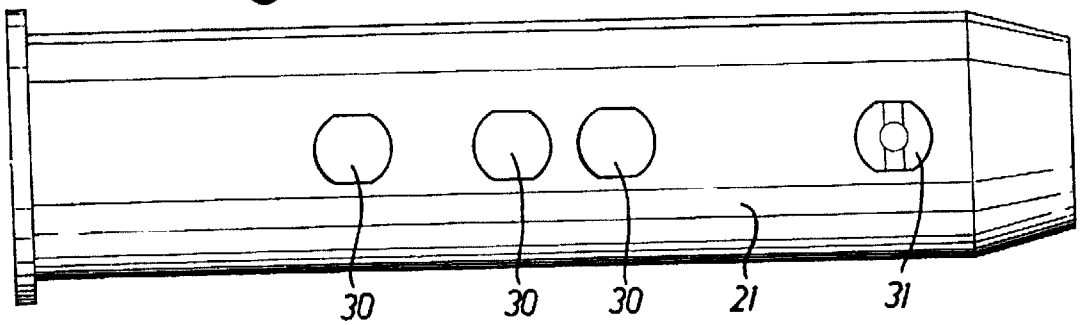
FIG. 5 is a plan view of the device in accordance with FIG. 3, having been turned over 90°.

FIGS. 3–5 illustrate a different embodiment based on the same inventive concept. In this case the guide sleeve 21 rests in position against the intermediate sleeve 22 and the latter is supported against the outer edge 23 of a conical portion 24 of the inner sleeve 25. A compression spring 26 is held between the conical portion 24 and an annular flange 27 mounted on the intermediate sleeve 22.

The unwinding roller 4, the guide sleeve 21 and the intermediate sleeve 22 are arranged to perform a tilting movement against the action of the spring 26, either upwards or downwards, should skewing or oblique pulling of the ink ribbon 25 occur. In this case the outer edge 23 thus will act as the pivotal movement pivot point.

In accordance with this embodiment the rotatable shaft 8 is provided with several blind bores 28. By means of a threaded pin 29 the inner sleeve 25 may be screwed in position in any one of the positions along the rotatable shaft 8 that correspond to the bores 28.

The guide sleeve 21 is provided with several apertures 30. A spring-actuated push-button 31 is arranged to project into any one of the apertures 30 in order to immobilize the guide sleeve 21 with respect to the intermediate sleeve 22 and the inner sleeve 25. When the pushbutton 31 is depressed it is possible to push the guide sleeve 21 over the intermediate sleeve 22 until the pushbutton 31 snaps back into one of the other apertures 30. In this manner, adaptation of the position of the guide sleeve 21 is possible after completion of the displacement of the inner sleeve 25 along the rotatable shaft 8.

The invention is not limited to the embodiments as described and illustrated in the drawings but could be altered in a variety ways within the scope of the appended claims. The most simple variety of the embodiment according to FIG. 2 could for instance comprise the disposition of the resilient ring 12 intermediate the guide sleeve 9 and the rotatable shaft 8 in direct abutment against the shaft.

As a third embodiment a universal-joint type of suspension of the unwinding roller 4 on the rotatable shaft 8 is possible, in which case some damping means, for instance foamed plastic, is arranged at the outer portion of the roller.

In some connections it could be advantageous to provide a pivot mechanism arrangement both in the unwinding roller 4 and in the take-up roller 6 of the ink ribbon 5.

We claim:

1. A printing device for preventing skewing of an ink ribbon which is unwound from an unwinding roller, passed through a printing unit simultaneously with a web onto which print is applied, and rewound onto a take-up roller after being passed through the printing unit, the printing device comprising:

a pivot mechanism mounted on a respective rotatable shaft of an unwinding roller having a hollow core, which said core having an inner surface;

said pivot mechanism having a resilient ring, a guide sleeve, said guide sleeve being in abutting contact with the inner surface of said hollow core, said ring being inserted between said rotatable shaft and said guide sleeve, wherein said ring cooperates with said guide sleeve and said unwinding roller such that said guide sleeve and said unwinding roller tilt between a first concentric position with respect to the rotatable shaft and a second inclined position with respect to the rotatable shaft.

2. The device of claim 1 further comprising:

an integral unit having the guide sleeve, the resilient ring and an intermediate sleeve; and an inner sleeve mounted on the rotatable shaft, the resilient ring being disposed between the guide sleeve and the intermediate sleeve, the integral unit being threadably attachable to the inner sleeve.

3. The device of claim 2 further comprising:

at least one locking tongue provided on the inner sleeve;

at least one peripheral groove formed on the rotatable shaft, said tongue being resiliently engagable in said groove;

a spring biasing means; and a locking member, the locking member being abutable against said locking tongue, wherein the tongue is engagable within the groove from the bias of the spring biasing means so as to prevent axial displacement of the inner sleeve along the rotatable shaft.

* * * * *